US012127697B2

(12) United States Patent
Lixin et al.

(10) Patent No.: US 12,127,697 B2
(45) Date of Patent: Oct. 29, 2024

(54) CUP LID WITH RETRACTABLE DRINKING SPOUT AND DRINKING CUP

(71) Applicant: Ningbo Lisi Houseware Co., Ltd., Ningbo (CN)

(72) Inventors: Li Lixin, Ningbo (CN); Zhou Yongning, Ningbo (CN); Liu Junhui, Ningbo (CN); Wang Lu, Ningbo (CN)

(73) Assignee: Ningbo Lisi Houseware Co., Ltd., Ningbo (CN)

( * ) Notice: Subject to any disclaimer, the term of this patent is extended or adjusted under 35 U.S.C. 154(b) by 45 days.

(21) Appl. No.: 18/114,728

(22) Filed: Feb. 27, 2023

(65) Prior Publication Data

US 2024/0138603 A1 May 2, 2024

(30) Foreign Application Priority Data

Oct. 27, 2022 (CN) ..... 202211323302.3

(51) Int. Cl.
*A47G 19/22* (2006.01)
*A47G 21/18* (2006.01)

(52) U.S. Cl.
CPC ..... *A47G 19/2272* (2013.01); *A47G 21/189* (2013.01)

(58) Field of Classification Search
None
See application file for complete search history.

(56) References Cited

U.S. PATENT DOCUMENTS 1,328,881 A * 1/1920 Lazarus ..... B65D 47/061 222/514
2,049,900 A * 8/1936 Evans ..... B65D 47/061 222/541.6
5,356,017 A 10/1994 Rohr
2004/0217139 A1 11/2004 Roth
2005/0205607 A1 9/2005 Hiezer
2007/0251909 A1 11/2007 Decelles
(Continued)

FOREIGN PATENT DOCUMENTS

CN 203417049 U 2/2014
CN 203576196 U 5/2014
(Continued)

OTHER PUBLICATIONS

English translation of CN217338130 obtained from google patents on Jun. 6, 2024. (Year: 2022).*
English translation of CN217338130 (Year: 2022).*

*Primary Examiner* — Don M Anderson
(74) *Attorney, Agent, or Firm* — Hanley, Flight & Zimmerman, LLC

(57) ABSTRACT

Provided is a cup lid with a retractable drinking spout and drinking cup, including a cup lid body provided with a through hole; a base fixedly connected to the cup lid body and located at a bottom of the through hole; a drinking spout movably installed in the through hole and capable of stretching out from a top of the through hole or retracting into the through hole; and an elastic part arranged in the through hole and having one end in butting connection with the base and the other end in butting connection with the drinking spout, the elastic part pushing the drinking spout to stretch out when popping up, and the elastic part being compressed to accumulate force when the drinking spout retracts.

20 Claims, 7 Drawing Sheets

(56) References Cited

U.S. PATENT DOCUMENTS

| | | | | |
|---|---|---|---|---|
| 2010/0170910 | A1 | 7/2010 | Ludewigs | |
| 2011/0266251 | A1* | 11/2011 | Rigel | B65D 47/061 215/386 |
| 2013/0068799 | A1* | 3/2013 | Rigel | B65D 47/061 222/537 |
| 2014/0117016 | A1 | 5/2014 | Hodge | |
| 2014/0224802 | A1 | 8/2014 | Gonnert | |
| 2014/0299599 | A1 | 10/2014 | Hodge | |
| 2014/0305941 | A1 | 10/2014 | Hodge | |
| 2014/0319138 | A1 | 10/2014 | Polt | |
| 2014/0339247 | A1 | 11/2014 | Gonnert | |
| 2015/0173539 | A1* | 6/2015 | Mason | B65D 77/283 220/715 |
| 2015/0217909 | A1* | 8/2015 | Garcia Cortes | B65D 47/043 222/511 |
| 2015/0246759 | A1* | 9/2015 | Testa | B65D 47/061 222/522 |
| 2015/0282654 | A1 | 10/2015 | Kurabe et al. | |
| 2016/0130045 | A1 | 5/2016 | Giraud | |
| 2016/0229597 | A1 | 8/2016 | Polt | |
| 2018/0208369 | A1* | 7/2018 | Rigel | B65D 47/061 |
| 2021/0147124 | A1* | 5/2021 | Jung | B65D 47/2031 |
| 2021/0362917 | A1* | 11/2021 | Pearce | B65D 47/28 |
| 2023/0109934 | A1* | 4/2023 | Huang | A47G 21/18 222/556 |

FOREIGN PATENT DOCUMENTS

| | | | |
|---|---|---|---|
| CN | 203969967 | U | 12/2014 |
| CN | 104921549 | A | 9/2015 |
| CN | 104973324 | U | 10/2015 |
| CN | 205053621 | Y | 3/2016 |
| CN | 205107161 | U | 3/2016 |
| CN | 205107162 | U | 3/2016 |
| CN | 105996666 | A | 10/2016 |
| CN | 107581855 | A | 1/2018 |
| CN | 207912509 | Y | 9/2018 |
| CN | 210748562 | U | 6/2020 |
| CN | 211408480 | U | 9/2020 |
| CN | 212489448 | U | 2/2021 |
| CN | 213097338 | U | 5/2021 |
| CN | 213587982 | U | 7/2021 |
| CN | 213882734 | U | 8/2021 |
| CN | 216256550 | U | 4/2022 |
| CN | 216724040 | U | 6/2022 |
| CN | 217338130 | U | 9/2022 |
| CN | 217565583 | U | 10/2022 |

* cited by examiner

CUP LID WITH RETRACTABLE DRINKING SPOUT AND DRINKING CUP

This patent claims priority to Chinese Patent Application No. 202211323302.3, filed on Oct. 27, 2022, which is hereby incorporated by reference in their entireties for all purposes.

BACKGROUND OF THE INVENTION

1. Technical Field

The invention belongs to the technical field of drinking cups and relates to a cup lid with a retractable drinking spout and further relates to a drinking cup.

2. Description of Related Art

The drinking spout is a very important part of a cup lid, and the length of the drinking spout will affect the user experience. If a part of the drinking spout protruding from a cup lid body is too long, in order to cover the drinking spout, a suitable lid needs to be designed, resulting in an increase in the overall height of the cup lid. If the part of the drinking spout protruding from the cup lid body is too short, it is not conducive to drinking water.

At present, a small number of cup lids adopt a retractable drinking spout structure. For example, a Chinese Invention Patent Application No. 202221234690.3 discloses an easy-to-clean double-drinking-spout cup lid. A straw of the cup lid actually functions as a drinking spout, and the straw is configured to has a retractable structure. However, since this cup lid essentially achieves the retractable effect of the drinking spout through a retractable straw, the coup lid is more complicated in structure and still needs to be improved in use effect.

BRIEF SUMMARY OF THE INVENTION

The invention is directed to the above problems existing in the prior art and intended to provide a cup lid with a retractable drinking spout and further provide a drinking cup.

The objective of the invention can be achieved through the following technical solutions: a cup lid with a retractable drinking spout, including:

- a cup lid body provided with a through hole;
- a base fixedly connected to the cup lid body and located at a bottom of the through hole;
- a drinking spout movably installed in the through hole and capable of stretching out from a top of the through hole or retracting into the through hole; and
- an elastic part arranged in the through hole and having one end in butting connection with the base and the other end in butting connection with the drinking spout, the elastic part pushing the drinking spout to stretch out when popping up, and the elastic part being compressed to accumulate force when the drinking spout retracts.

Preferably, the cup lid with a retractable drinking spout further includes a cover, wherein the cover is rotatably connected with the cup lid body and can be closed on the cup lid body or opened from the cup lid body; when closed, the cover pushes the drinking spout back into the through hole; when the cover is opened, the elastic part pushes the drinking spout to stretch out from the top of the through hole.

Preferably, a sealing ring is arranged between the drinking spout and the through hole, and the sealing ring is fitted over the drinking spout and seals a gap between the drinking spout and the through hole.

Preferably, an outer rim of the sealing ring is surrounded by at least one ring of annular valve, the through hole has a necking portion, and the annular valve is in butting connection with an inner wall of the through hole; when the drinking spout stretches out, the annular valve comes into butting connection with an inner wall of the necking portion, and a resistance is generated between the annular valve and the inner wall of the necking portion to prevent the drinking spout from retracting.

Preferably, the cover is provided with a beveled push block for pushing the drinking spout back when the cover is closed.

Preferably, an outer wall of the drinking spout has a guide block, the inner wall of the through hole has a chute arranged along a moving direction of the drinking spout, and the guide block is connected with the chute; alternatively, the inner wall of the through hole has a guide block, the outer wall of the drinking spout has a chute arranged along the moving direction of the drinking spout, and the guide block is connected with the chute.

Preferably, the base is provided with at least two elastic sheets, the elastic sheet is provided with a buckle, the inner wall of the cup lid body has the same number of slots as the number of the elastic sheets, and the buckles are connected to the slots so that the base is fixed at the bottom of the through hole.

Preferably, the base is configured as a ring-shaped structure and has a bottom hole aligned with the through hole.

Preferably, the cup lid with a retractable drinking spout further includes a button, wherein the button is rotatably connected to the cup lid body, and a return spring is arranged between the button and the cup lid body; the cover is closed on the cup lid body, the button buckles the cover so as to limit the cover from opening.

The invention further provides a drinking cup, including the cup lid with a retractable drinking spout, and further including a cup body connected to the cup lid body.

Compared with the prior art, the invention has the following beneficial effects:

1. The base for supporting the elastic part is arranged at the bottom of the through hole, and the automatic stretching effect of the drinking spout is achieved through the elastic part. The drinking spout can also be pressed into the through hole to achieve the retracting effect. Moreover, the cup lid is simple and ingenious in overall structure and also has very good use effect.
2. The action of the cover can control the drinking spout to stretch out and retract. The drinking spout can pop up automatically when the cover is opened and the drinking spout can automatically retract after the cover is closed, so the operation is convenient.
3. When the drinking spout stretches out, the annular valve can smoothly enter into the necking portion. Once the drinking spout stretching out is pushed towards the inside of the through hole, the annular valve can hinder the drinking spout, thereby preventing the drinking spout from retracting.
4. In actual assembly, the drinking spout is inserted from the bottom of the through hole, the elastic part is then placed in place, and finally the base is mounted. In addition, the base is connected to the cup lid body by the buckles. The assembly process is very simple.

Figure 1:
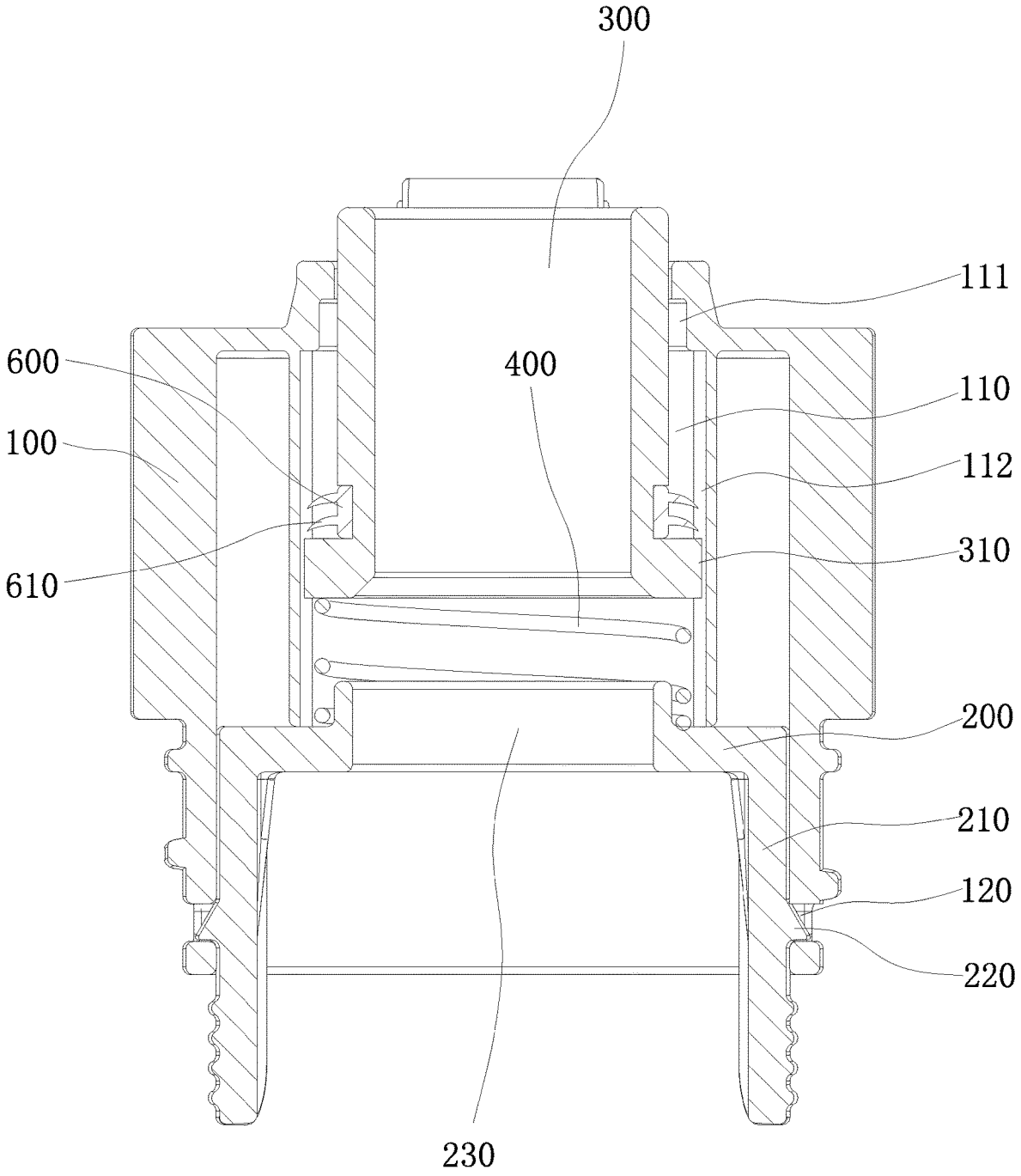
FIG. 1 is a schematic structural diagram of a cup lid with a retractable drinking spout according to the invention.

In the figures, 100. cup lid body; 110. through hole; 111. necking portion; 112. chute; 120. slot; 200. base; 210. elastic sheet; 220. buckle; 230. bottom hole; 300. drinking spout; 310. guide block; 400. elastic part; 500. cover; 510. beveled push block; 600. sealing ring; 610. annular valve; 700. button; 710. return spring; and 800. cup body.

DETAILED DESCRIPTION OF THE INVENTION

The following are specific embodiments of the invention and further describe the technical solutions of the invention in conjunction with the accompanying drawings, but the invention is not limited to these embodiments.

Referring to FIGS. 1-6, illustrated is a cup lid with a retractable drinking spout, including a cup lid body 100, a base 200, a drinking spout 300, and an elastic part 400. The cup lid body 100 is provided with a through hole 110. The base 200 is fixedly connected to the cup lid body 100 and located at a bottom of the through hole 110. The drinking spout 300 is movably installed in the through hole 110 and capable of stretching out from a top of the through hole 110 or retracting into the through hole 110. The elastic part 400 is arranged in the through hole 110 and has one end in butting connection with the base 200 and the other end in butting connection with the drinking spout 300. The elastic part 400 pushes the drinking spout 300 to stretch out when popping up. The elastic part 400 is compressed to accumulate force when the drinking spout 300 retracts.

The through hole 110 is arranged along the axial direction of the cup lid body 100 and runs through the cup lid body 100, the drinking spout 300 is in a tubular structure, and the base 200 is in a ring-shaped structure, so water in a cup body 800 can enter the through hole 110 through the base 200, and flows out from the drinking spout 300. The top and the bottom of the through hole 110 are two ends of the through hole 110. Since the base 200 is supported on the bottom of the through hole 110, one end of the elastic part 400 can be supported by the base 200, and the other end of the elastic part 400 is connected to the drinking spout 300 and can push the drinking spout 300 to stretch out from the top of the through hole 110.

It should be noted that the drinking spout 300 and the base 200 actually form a split-type drinking spout assembly structure, wherein the base 200 can be independently assembled into the cup lid body 100 from the bottom of the cup lid body 100. Moreover, the design of the split-type drinking spout assembly structure is very ingenious, and in actual assembly, the drinking spout 300 is inserted from the bottom of the through hole 110, the elastic part 400 is then placed in place, and finally the base 200 is mounted. In addition, the base 200 is connected to the cup lid body 100 by buckles. The assembly process is very simple.

When the cup lid is not in use, the drinking spout 300 is hidden in the through hole 110, and the elastic part 400 is in a compressed state to accumulate force, so that there will be no protruding structure on the surface of the cup lid body 100. In use, the elastic part 400 pushes the drinking spout 300 to stretch out from the top of the through hole 110, which is convenient for people to drink water The base 200 for supporting the elastic part 400 is arranged at the bottom of the through hole 110, and the automatic stretching effect of the drinking spout 300 is achieved through the elastic part 400. The drinking spout 300 can also be pressed into the through hole 110 to achieve the retracting effect. Moreover, the cup lid is simple and ingenious in overall structure and also has very good use effect.

The cup lid with a retractable drinking spout further includes a cover 500. The cover 500 is rotatably connected with the cup lid body 100 and can be closed on the cup lid body 100 or opened from the cup lid body 100. When closed, the cover 500 pushes the drinking spout 300 back into the through hole 110. When the cover 500 is opened, the elastic part 400 pushes the drinking spout 300 to stretch out from the top of the through hole 110.

In actual application, once the cover 500 is opened, the drinking spout 300 can automatically stretch out under the push of the elastic part 400, which is convenient for drinking water. When closed, the cover 500 can push the drinking spout 300 back into the through hole 110. Therefore, the action of the cover 500 can control the drinking spout 300 to stretch out and retract. The drinking spout 300 can pop up automatically when the cover 500 is opened and the drinking spout 300 can automatically retract after the cover 500 is closed. The operation is convenient.

Referring to FIGS. 1-5, a sealing ring 600 is arranged between the drinking spout 300 and the through hole 110, the sealing ring 600 is fitted over the drinking spout 300 and seals a gap between the drinking spout 300 and the through hole 110.

It should be noted that the sealing ring 600 moves along with the movement of the drinking spout 300, that is, the sealing ring 600 and the drinking spout 300 are fixed together. The sealing ring 600 seals the gap between the drinking spout 300 and the through hole 110, which can prevent water from flowing out from the gap on the side of the drinking spout 300.

On the basis of the above embodiment, an outer rim of the sealing ring 600 is surrounded by at least one ring of annular valve 610. The through hole 110 has a necking portion 111. The annular valve 610 is in butting connection with an inner wall of the through hole 110. When the drinking spout 300 stretches out, the annular valve 610 comes into butting connection with an inner wall of the necking portion 111, and a resistance is generated between the annular valve 610 and the inner wall of the necking portion 111 to prevent the drinking spout 300 from retracting.

The annular valve 610 is integrally connected with the sealing ring 600, and the edge of the annular valve 610 is in butting connection with the inner wall of the through hole 110 to achieve a sealing effect, thereby preventing water leaking from the side of the drinking spout 300. It should be noted that a plurality of annular valves 610 can better achieve a sealing effect, and the resistance generated to hinder the retraction of the drinking spout 300 is also greater. The necking portion 111 is a necking structure near the top of the through hole 110, so the inner diameter of the necking portion 111 is less than the inner diameter of the other parts of the through hole 110.

The shape and direction of the annular valve 610 are specially designed, and the annular valve 610 is arranged in an inclined manner, so when the annular valve 610 moves toward the necking portion 111, the annular valve 610 itself deforms easily and will not be hindered. When the annular valve 610 moves toward the bottom of the through hole 110, the annular valve 610 is caught by the necking portion 111 and can hardly deform, thereby generating a resistance. The annular valve 610 moves very smoothly at other positions in the through hole 110 and can be easily inserted into the necking portion 111. Once the annular valve 610 moves to the necking portion 111, the annular valve 610 allows the drinking spout 300 to pop up and prevents the drinking spout 300 from retracting. In this way, even if people touches the drinking spout 300 when drinking water, the drinking spout 300 will not retract.

Specifically, although the drinking spout 300 is supported by the elastic part 400 when stretching out, people may push the drinking spout 300 inward when drinking water, and the drinking spout 300 retracts a certain distance into the through hole 110, resulting in poor user experience. In this embodiment, when the drinking spout 300 stretches out, the annular valve 610 can enter the necking portion 111 very smoothly, once the drinking spout 300 stretching out is pushed towards the inside of the through hole 110, the annular valve 610 can hinder the drinking spout 300, thereby preventing the drinking spout 300 from retracting.

Figure 2:
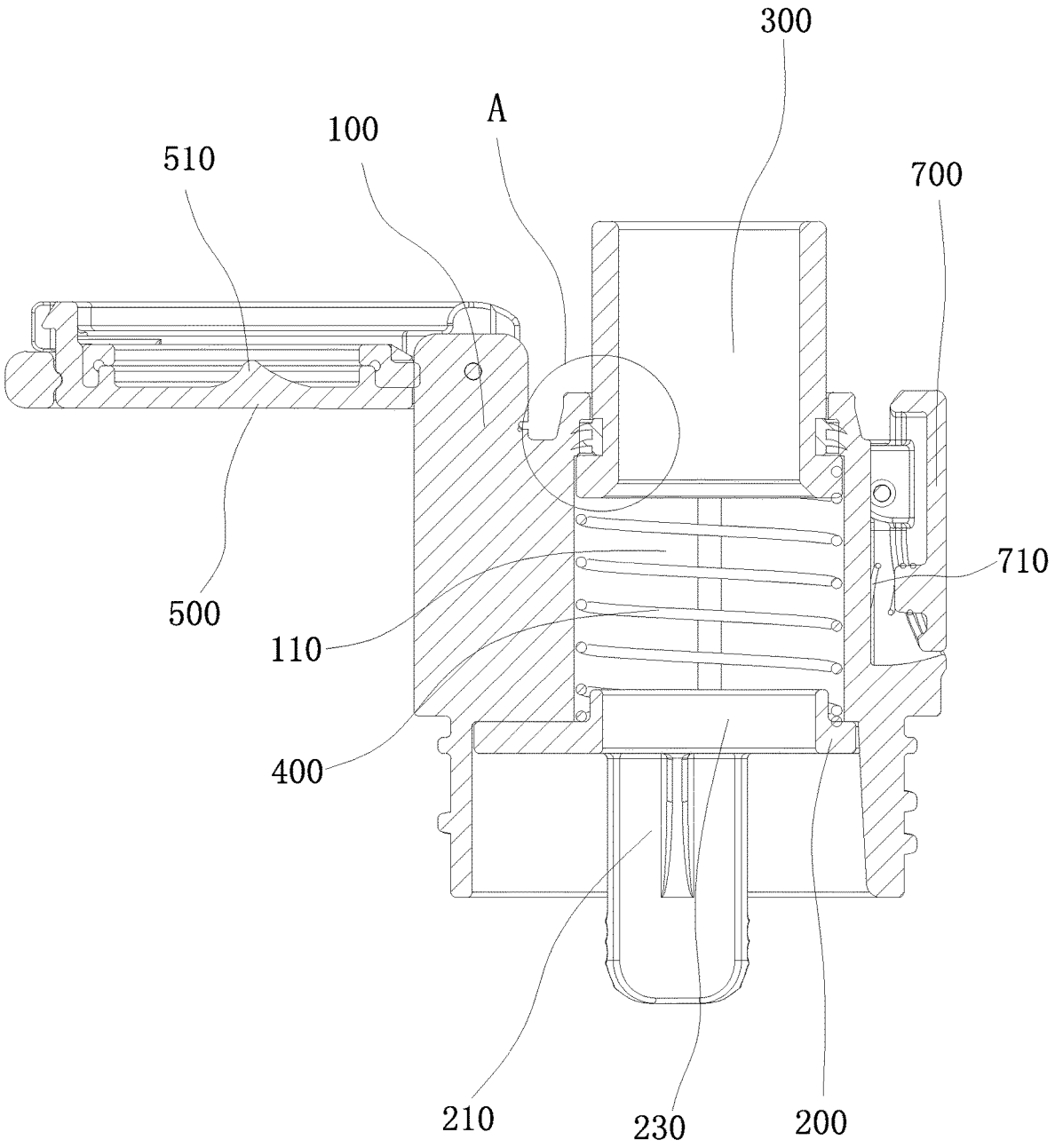
FIG. 2 is a schematic structural diagram of the cup lid with a retractable drinking spout according to the invention when opened.
Figure 3:
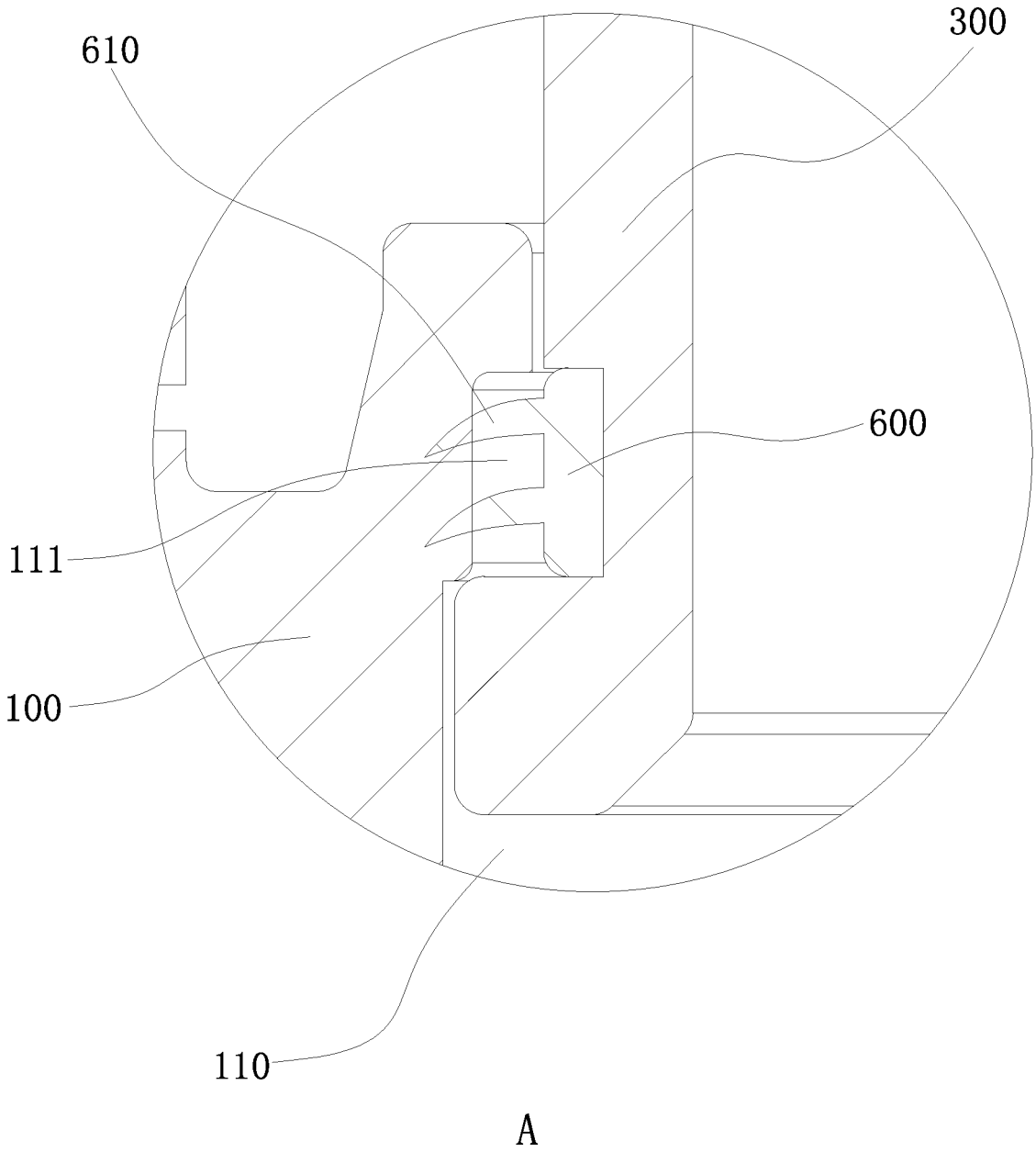
FIG. 3 shows an enlarged schematic diagram of part A in FIG. 2.
Figure 4:
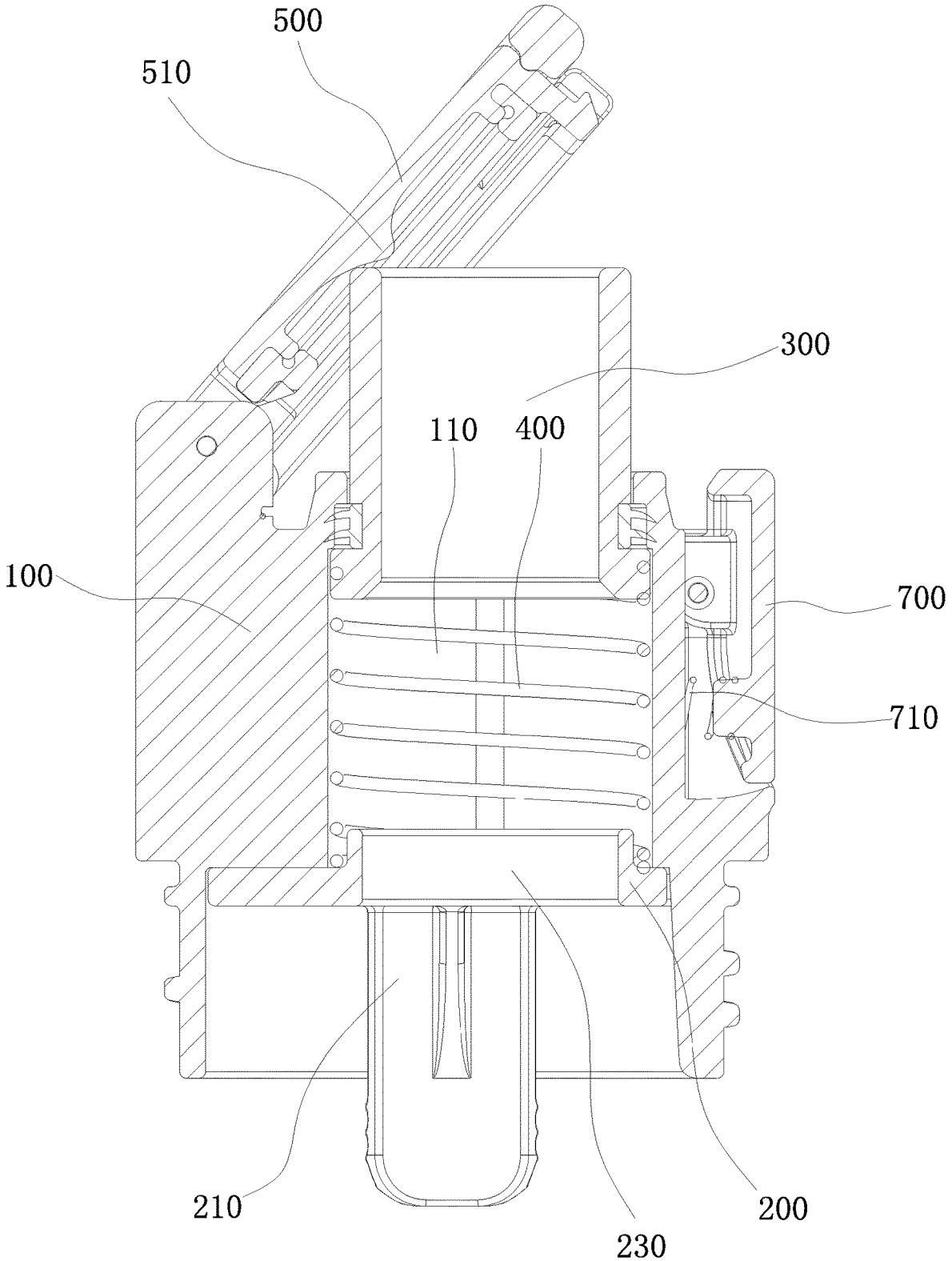
FIG. 4 is a schematic structural diagram of the cup lid with a retractable drinking spout according to the invention when being opened.
Figure 5:
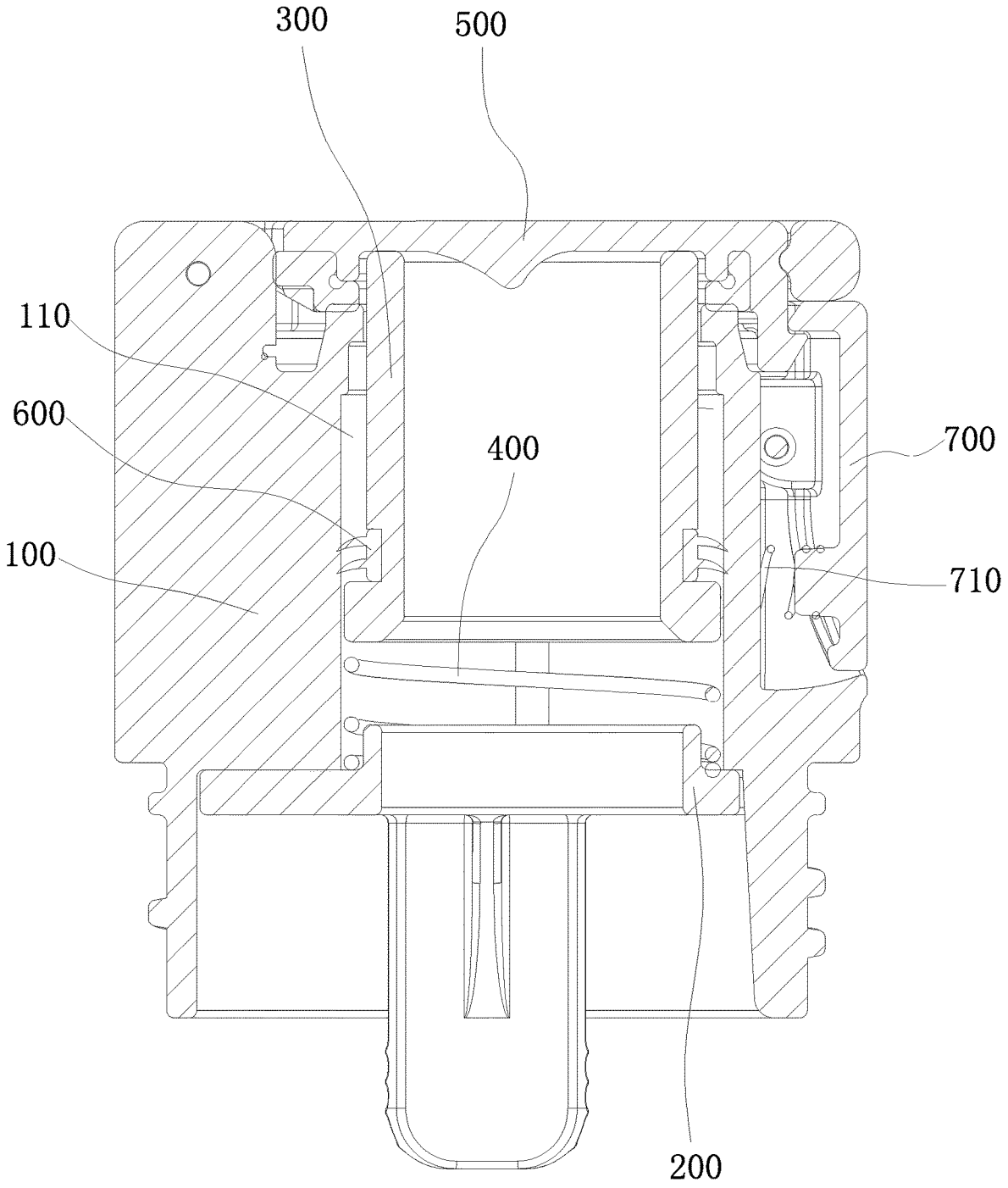
FIG. 5 is a schematic structural diagram of the cup lid with a retractable drinking spout according to the invention when being opened.
Figure 6:
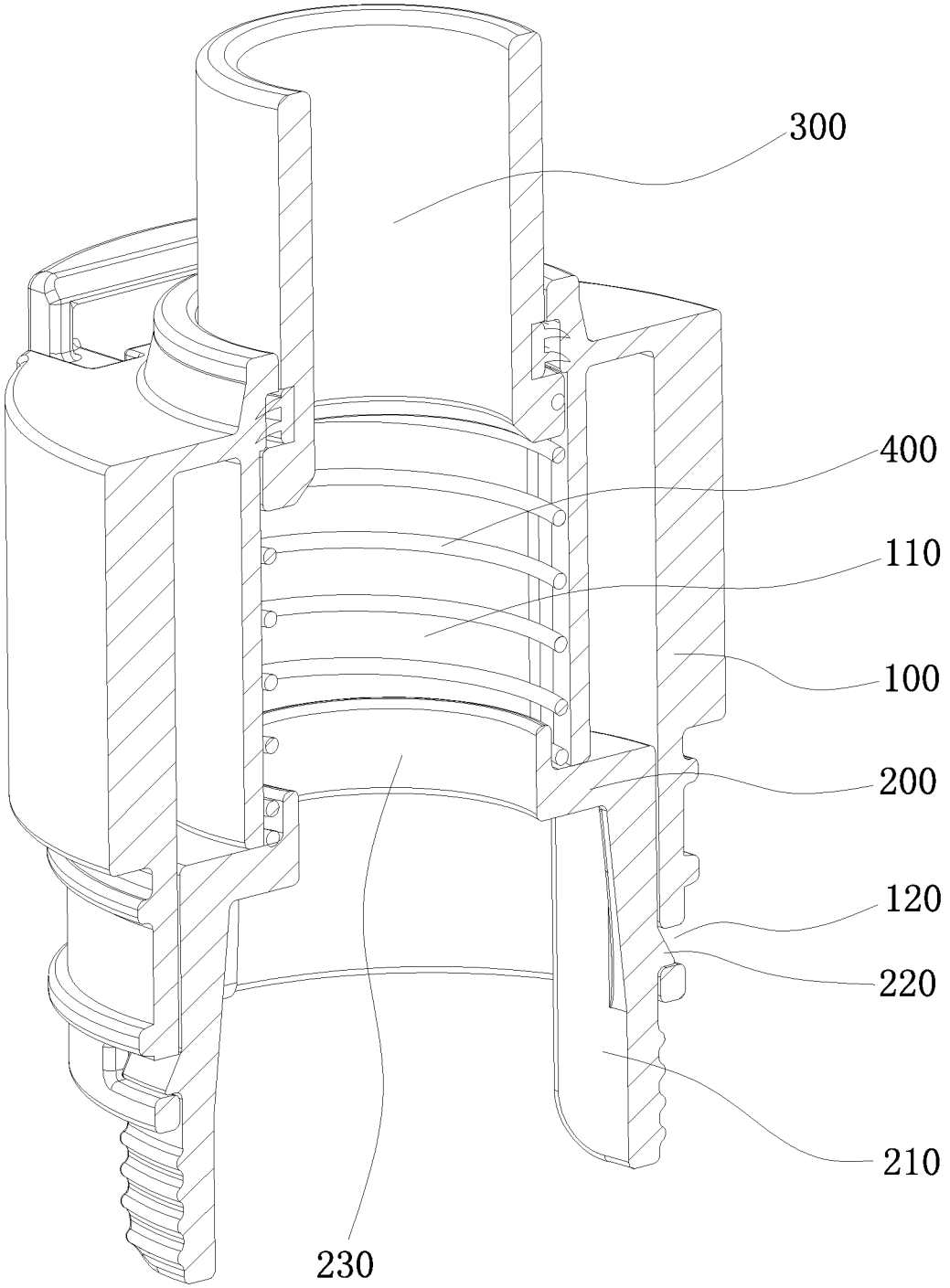
FIG. 6 is a half-section axonometric view of the cup lid with a retractable drinking spout according to the invention.

Referring to FIGS. 2-4, the cover 500 is provided with a beveled push block 510 for pushing the drinking spout 300 back when the cover 500 is closed.

If the drinking spout 300 is pressed down directly by the cover, the drinking spout 300 may be caught and cannot retract normally. In order to allow the drinking spout 300 to retract more smoothly, the beveled push block 510 is specially provided in this embodiment. When the cover 500 is doing the closing movement, the bevel on the beveled push block 510 can convert the downward turning motion of the cover 500 into a vertical pressure that presses the drinking spout 300 down, and then the drinking spout 300 can smoothly retract in the through hole 110 during the closing process of the cover.

Referring to FIG. 1, an outer wall of the drinking spout 300 has a guide block 310, the inner wall of the through hole 110 has a chute 112 arranged along a moving direction of the drinking spout 300, and the guide block 310 is connected with the chute 112. Alternatively, the inner wall of the through hole 110 has a guide block 310, the outer wall of the drinking spout 300 has a chute 112 arranged along the moving direction of the drinking spout 300, and the guide block 310 is connected with the chute 112. In this way, the drinking spout 300 can be guided to retract and limited from rotating inside the through hole 110.

Referring to FIGS. 1-6, the base 200 is provided with at least two elastic sheets 210. The elastic sheet 210 is provided with a buckle 220. The inner wall of the cup lid body 100 has a same number of slots 120 as the number of the elastic sheets 210, and the buckles 220 are connected to the slots 120 so that the base 200 is fixed at the bottom of the through hole 110.

The base 200 is detachably assembled in the cup lid body 100. After all the elastic sheets 210 are pushed inward, the base 200 is placed in the cup lid body 100, and the buckles 220 are aligned with the slots 120, and then all the elastic sheets 210 are released. The elastic sheets 210 return the original positions, and then the buckles 220 are connected with the slots 120. In this way, the rapid installation of the base 200 is realized.

It should be added that the base 200 is configured as a ring-shaped structure and has a bottom hole 230 aligned with the through hole 110, and water in the cup body 800 can enter the through hole 110 through the bottom hole 230 and flows out from the drinking spout 300.

It should further be added that there is an annular gap between the base 200 and the through hole 110, the elastic part 400 is preferably configured as a spring, and the end of the elastic part 400 is caught in the annular gap, so that the elastic part 400 is better mounted on the base 200.

Referring to FIGS. 2-5, the cup lid with a retractable drinking spout further includes a button 700. The button 700 is rotatably connected to the cup lid body 100, and a return spring 710 is arranged between the button 700 and the cup lid body 100. The cover 500 is closed on the cup lid body 100, the button buckles the cover 500 so as to limit the cover 500 from opening.

The return spring 710 can provide an elastic force for the return of the button 700. A torsion spring is arranged between the cover 500 and the cup lid body 100. After the button 700 is pressed, the cover 500 is automatically opened under the action of the torsion spring, and the back cover body 500 is opened. The sealing ring on the opened cover 500 rubs against the cup lid body 100 to buffer the opening speed of the cover 500, and the button 700 returns to a certain extent under the action of the return spring 710 and comes into butting connection with one surface of the cup lid body 100, thus preventing over-return of the button 700.

Figure 7:
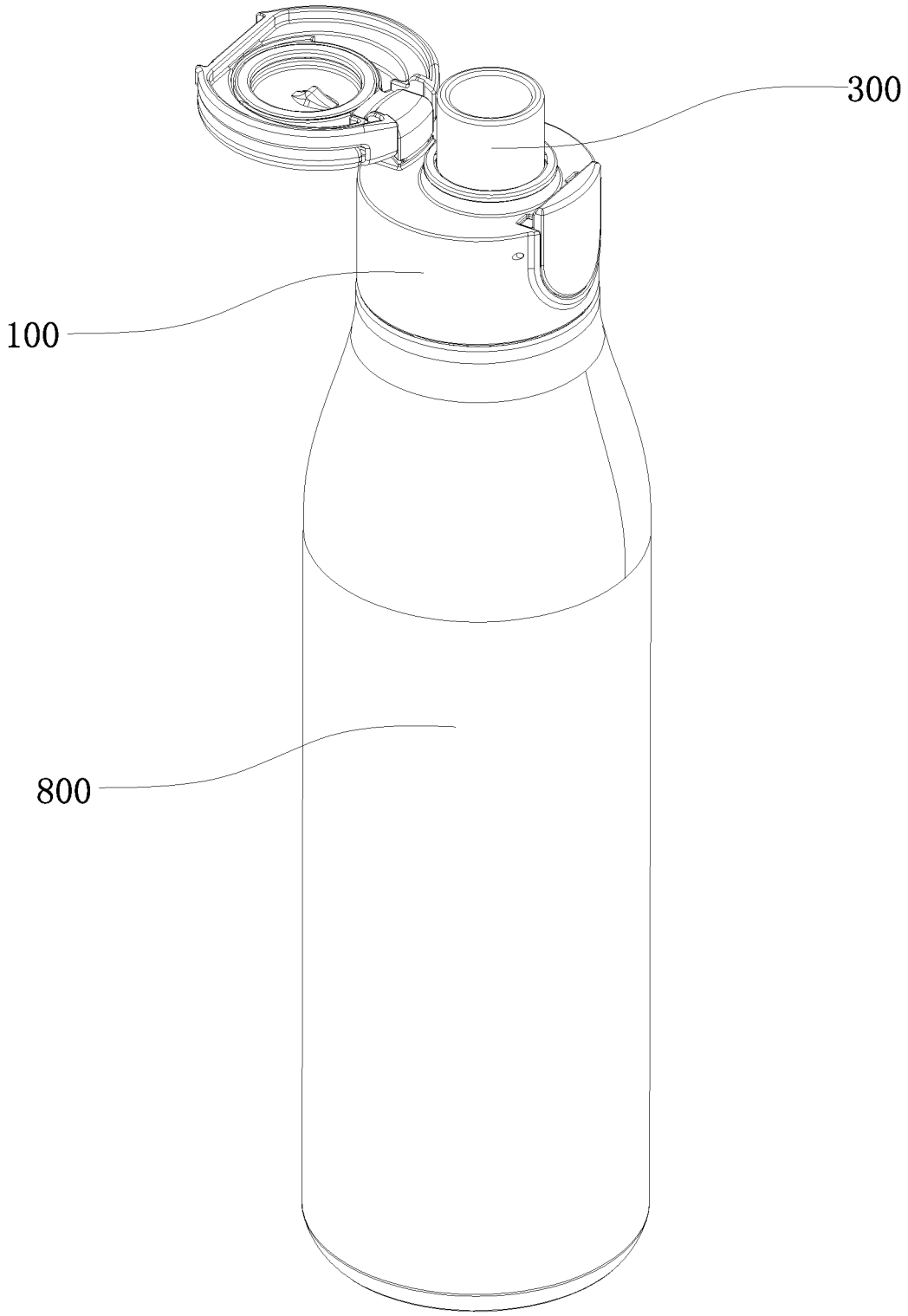
FIG. 7 is a schematic structural diagram of a drinking cup according to the invention.

As shown in FIG. 7, further provided is a drinking cup, including the cup lid with a retractable drinking spout, and further including a cup body 800 connected to the cup lid body 100.

It should be noted that all directional indications (such as up, down, left, right, front, back) in the embodiments of the invention are only used to explain a relative positional relationship, motion, etc. between the various components in a specific attitude (as shown in the accompanying drawings). If the specific attitude changes, the directional indications will also change accordingly.

In addition, descriptions such as "first", "second", "one", etc. in the invention are only used for description purposes, and should not be construed as indicating or implying a relative importance or implicitly indicating the number of technical features indicated. Thus, features defined by the term "first" or "second" may include at least one of the features, either explicitly or implicitly. In the description of the invention, "a plurality of" means at least two, such as two, three, etc., unless otherwise expressly and specifically defined.

In the invention, unless otherwise expressly specified and defined, the terms "connected", "fixed" and the like should be understood in a broad sense. For example, the connection may be either a fixed connection or a detachable connection, or in one piece; it may be a mechanical connection, or it may be an electrical connection; it may be a direct connection or indirect connection through an intermediate medium, and may be an internal communication of two components or an interaction relationship between two components, unless otherwise expressly defined. For those skilled in the art, the specific meanings of the above terms in the present disclosure could be understood according to the specific conditions.

In addition, the technical solutions of the various embodiments of the invention can be combined with each other, but must be based on the implementation by those of ordinary skill in the art. When the combination of technical solutions contradicts each other or cannot be implemented, it should be considered that such combination of technical solutions does not exist and does not fall within the scope of the invention.

What is claimed is:

1. A cup lid comprising:

a cup lid body provided with a through hole;

a base connected to the cup lid body and located at a bottom of the through hole;

a drinking spout movably installed in the through hole and capable of extending from a top of the through hole and retracting into the through hole;

an elastic part in the through hole and having one end in butting connection with the base and the other end in butting connection with the drinking spout, the elastic part pushing the drinking spout to extend, and the elastic part being compressed when the drinking spout retracts;

a sealing ring between the drinking spout and the through hole, and the sealing ring fitted over the drinking spout and seals a gap between the drinking spout and the through hole; and an annular valve, wherein an outer rim of the sealing ring is surrounded by at least one ring of the annular valve, the through hole has a necking portion, and the annular valve is in butting connection with an inner wall of the through hole, and wherein when the drinking spout is extended, the annular valve comes into butting connection with an inner wall of the necking portion, and a resistance is generated between the annular valve and the inner wall of the necking portion to prevent the drinking spout from retracting.

2. The cup lid according to claim 1, further including a cover, wherein the cover is rotatably connected with the cup lid body and can be closed on the cup lid body or opened from the cup lid body; when the cover is closed, the cover pushes the drinking spout back into the through hole; when the cover is opened, the elastic part pushes the drinking spout to extend from the top of the through hole.

3. A cup lid comprising:

a cup lid body provided with a through hole;

a base connected to the cup lid body and located at a bottom of the through hole;

a drinking spout movably installed in the through hole and capable of extending from a top of the through hole and retracting into the through hole;

an elastic part in the through hole and having one end in butting connection with the base and the other end in butting connection with the drinking spout, the elastic part pushing the drinking spout to extend, and the elastic part being compressed when the drinking spout retracts; and a cover rotatably connected with the cup lid body and movable between a closed position and an opened position, wherein when the cover is in the closed position, the cover pushes the drinking spout back into the through hole, wherein when the cover is in the opened position, the elastic part pushes the drinking spout to extend from the top of the through hole, and wherein the cover includes a beveled push block for pushing the drinking spout back when the cover is in the closed position.

4. The cup lid according to claim 1, wherein: (a) an outer wall of the drinking spout has a guide block, the inner wall of the through hole has a chute arranged along a moving direction of the drinking spout, and the guide block is connected with the chute; or (b) the inner wall of the through hole has a guide block, the outer wall of the drinking spout has a chute arranged along the moving direction of the drinking spout, and the guide block is connected with the chute.

5. The cup lid according to claim 1, wherein the base is configured as a ring-shaped structure and has a bottom hole aligned with the through hole.

6. The cup lid according to claim 2, further including a button, wherein the button is rotatably connected to the cup lid body, and a return spring is arranged between the button and the cup lid body, and wherein when the cover is closed on the cup lid body, the button buckles the cover so as to limit the cover from opening.

7. A drinking cup comprising:

the cup lid according to claim 1; and a cup body connected to the cup lid body.

8. The cup lid according to claim 3, further including a sealing ring between the drinking spout and the through hole, wherein the sealing ring is fitted over the drinking spout and seals a gap between the drinking spout and the through hole.

9. The cup lid according to claim 3, wherein: (a) an outer wall of the drinking spout has a guide block, the inner wall of the through hole has a chute arranged along a moving direction of the drinking spout, and the guide block is connected with the chute; or (b) the inner wall of the through hole has a guide block, the outer wall of the drinking spout has a chute arranged along the moving direction of the drinking spout, and the guide block is connected with the chute.

10. The cup lid according to claim 3, wherein the base includes a ring-shaped structure and has a bottom hole aligned with the through hole.

11. The cup lid according to claim 3, further including:

a button rotatably connected to the cup lid body; and a return spring between the button and the cup lid body, wherein when the cover is in the closed position, the button buckles the cover to limit the cover from opening.

12. The cup lid according to claim 3, further including a sealing ring having an outer rim that is surrounded by at least one ring of an annular valve, wherein the through hole has a necking portion, and the annular valve is in butting connection with an inner wall of the through hole, and wherein when the drinking spout is extended, the annular valve comes into butting connection with an inner wall of the necking portion, and a resistance is generated between the annular valve and the inner wall of the necking portion to prevent the drinking spout from retracting.

13. A drinking cup comprising:

the cup lid according to claim 3; and a cup body connected to the cup lid body.

14. A cup lid comprising:

a cup lid body provided with a through hole;

a base connected to the cup lid body and located at a bottom of the through hole;

a drinking spout movably installed in the through hole and capable of extending from a top of the through hole and retracting into the through hole; and an elastic part in the through hole and having one end in butting connection with the base and the other end in butting connection with the drinking spout, the elastic part pushing the drinking spout to extend, and the elastic part being compressed when the drinking spout retracts, wherein the base includes at least two elastic sheets, the elastic sheets each include a buckle, the inner wall of the cup lid body has the same number of slots as the number of the elastic sheets, and the buckles are connected to the slots so that the base is fixed at the bottom of the through hole.

15. The cup lid according to claim 14, further including a cover rotatably coupled to the cup lid body and movable between a closed position and an opened position, wherein when the cover is in the closed position, the cover pushes the drinking spout back into the through hole, and wherein when the cover is in the opened position, the elastic part pushes the drinking spout to extend from the top of the through hole.

16. The cup lid according to claim 15, further including:

a button rotatably connected to the cup lid body; and a return spring between the button and the cup lid body, wherein when the cover is in the closed position, the button buckles the cover to limit the cover from opening.

17. The cup lid according to claim 14, further including a sealing ring between the drinking spout and the through hole, wherein the sealing ring is fitted over the drinking spout and seals a gap between the drinking spout and the through hole.

18. The cup lid according to claim 14, wherein: (a) an outer wall of the drinking spout has a guide block, the inner wall of the through hole has a chute arranged along a moving direction of the drinking spout, and the guide block is connected with the chute; or (b) the inner wall of the through hole has a guide block, the outer wall of the drinking spout has a chute arranged along the moving direction of the drinking spout, and the guide block is connected with the chute.

19. The cup lid according to claim 14, wherein the base includes a ring-shaped structure and has a bottom hole aligned with the through hole.

20. A drinking cup comprising:

the cup lid according to claim 14; and a cup body connected to the cup lid body.

* * * * *